US007922481B2

(12) United States Patent
Geiger et al.

(10) Patent No.: US 7,922,481 B2
(45) Date of Patent: Apr. 12, 2011

(54) METHOD FOR SETTING THE AIR RATIO ON A FIRING DEVICE AND A FIRING DEVICE

(75) Inventors: Martin Geiger, Bogen (DE); Ulrich Geiger, Bogen (DE); Rudolf Tungl, Ergolding (DE)

(73) Assignee: EBM—Papst Landshut GmbH, Landshut (DE)

( * ) Notice: Subject to any disclaimer, the term of this patent is extended or adjusted under 35 U.S.C. 154(b) by 145 days.

(21) Appl. No.: 11/630,563

(22) PCT Filed: Jun. 20, 2005

(86) PCT No.: PCT/EP2005/006628

§ 371 (c)(1),
(2), (4) Date: Jan. 28, 2008

(87) PCT Pub. No.: WO2006/000367

PCT Pub. Date: Jan. 5, 2006

(65) Prior Publication Data

US 2009/0017403 A1 Jan. 15, 2009

(30) Foreign Application Priority Data

Jun. 23, 2004 (DE) ..... 10 2004 030 300
Jun. 23, 2004 (DE) ..... 20 2004 017 850 U
Nov. 18, 2004 (DE) ..... 10 2004 055 715

(51) Int. Cl.

| | |
|---|---|
| ***F23N 1/02*** | (2006.01) |
| *F23N 1/00* | (2006.01) |
| *F23N 5/00* | (2006.01) |
| *F23N 5/18* | (2006.01) |
| *G05D 11/00* | (2006.01) |

(52) U.S. Cl. ..... 431/12; 431/75; 431/89

(58) Field of Classification Search ..... 431/12, 431/18, 75, 89; *F23K 5/00; F23N 1/00, F23N 1/02, 5/00, 5/18; G05D 11/00, 11/02, G05D 11/06*

See application file for complete search history.

(56) References Cited

U.S. PATENT DOCUMENTS 3,185,203 A * 5/1965 Hassa ..... 431/46

(Continued)

FOREIGN PATENT DOCUMENTS

DE 3701798 A1 * 8/1988

(Continued)

OTHER PUBLICATIONS

International Search Report (in English) for PCT/EP2005/006628, ISA/EP, mailed Oct. 14, 2005.

(Continued)

*Primary Examiner* — Steven B McAllister
*Assistant Examiner* — Daniel E Namay
(74) *Attorney, Agent, or Firm* — Harness, Dickey & Pierce, PLC

(57) ABSTRACT

The temperature generated by a firing apparatus, particularly a gas burner, depends on the mixing ratio between the quantity of air and the quantity of gas fed to the firing apparatus, characterized by the excess air coefficient λ, at a predefined burner load (air mass flow rate) in such a way that the temperature generated by the firing apparatus reaches a maximum when λ=1. According to the inventive method for adjusting the excess air coefficient, said maximum temperature $T_{max}$ is determined, whereupon the desired setpoint value $\lambda_{hy}$ of the excess air coefficient is adjusted and the associated setpoint temperature $T_{soll}$ is measured. A characteristic curve which represents the correlation between the respective air mass flow rates and the setpoint temperatures at the setpoint value $\lambda_{hy}$ of the excess air coefficient and allows combustion to be regulated to an optimal hygienic state can be determined from said determined correlation between the setpoint temperatures $T_{soll}$ at different predefined burner loads. The inventive firing apparatus is adapted to carry out said method and especially comprises a mass flow sensor in the air delivery zone as well as a temperature sensor in the effective range of the burner flame.

18 Claims, 3 Drawing Sheets

U.S. PATENT DOCUMENTS

Figure 1:
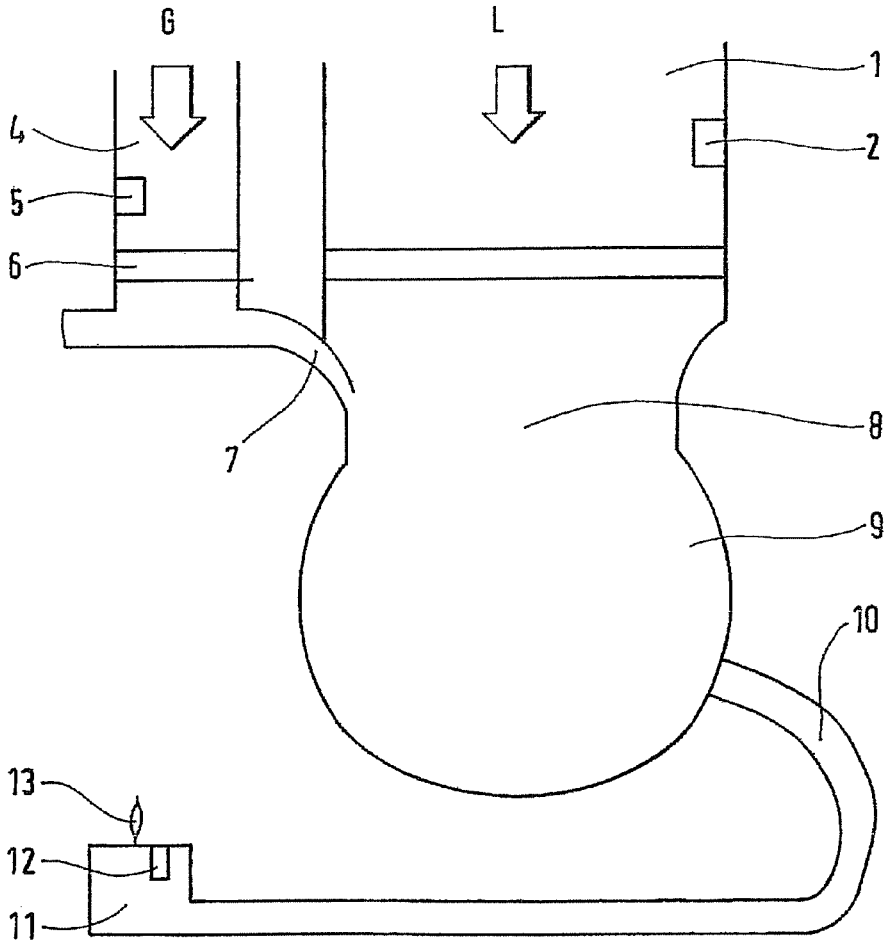

| | | | | | |
|---|---|---|---|---|---|
| 3,277,949 | A | * | 10/1966 | Walbridge | 431/6 |
| 3,280,884 | A | * | 10/1966 | Eckelberry et al. | 431/15 |
| 3,285,320 | A | * | 11/1966 | Clark | 431/12 |
| 3,369,749 | A | * | 2/1968 | Siegmund et al. | 431/12 |
| 3,374,950 | A | * | 3/1968 | Menzel et al. | 431/12 |
| 3,388,862 | A | * | 6/1968 | Gabrielson | 431/8 |
| 4,118,172 | A | * | 10/1978 | Noir et al. | 431/12 |
| 4,348,169 | A | * | 9/1982 | Swithenbank et al. | 431/89 |
| 4,435,149 | A | * | 3/1984 | Astheimer | 431/12 |
| 4,568,266 | A | * | 2/1986 | Bonne | 431/76 |
| 4,588,372 | A | * | 5/1986 | Torborg | 431/78 |
| 4,645,450 | A | * | 2/1987 | West | 431/12 |
| 4,934,926 | A | * | 6/1990 | Yamazaki et al. | 431/75 |
| 5,037,291 | A | * | 8/1991 | Clark | 431/12 |
| 5,049,063 | A | * | 9/1991 | Kishida et al. | 431/78 |
| 5,112,217 | A | * | 5/1992 | Ripka et al. | 431/12 |
| 5,158,448 | A | * | 10/1992 | Kawasaki et al. | 431/74 |
| 5,401,162 | A | * | 3/1995 | Bonne | 431/12 |
| 5,924,859 | A | * | 7/1999 | Nolte et al. | 431/12 |
| 5,971,745 | A | * | 10/1999 | Bassett et al. | 431/12 |
| 5,997,280 | A | * | 12/1999 | Welz et al. | 431/90 |
| 6,213,758 | B1 | * | 4/2001 | Tesar et al. | 431/12 |
| 6,299,433 | B1 | * | 10/2001 | Gauba et al. | 431/12 |
| 6,343,927 | B1 | * | 2/2002 | Eroglu et al. | 431/1 |
| 6,527,541 | B2 | * | 3/2003 | Lochschmied | 431/25 |
| 6,537,060 | B2 | * | 3/2003 | Vegter | 431/90 |
| 6,571,817 | B1 | * | 6/2003 | Bohan, Jr. | 137/88 |
| 6,745,708 | B2 | * | 6/2004 | Slater et al. | 110/348 |
| 7,198,483 | B2 | * | 4/2007 | Bueche et al. | 431/12 |
| 7,216,019 | B2 | * | 5/2007 | Tinsley et al. | 700/282 |
| 7,223,094 | B2 | * | 5/2007 | Goebel | 431/12 |
| 7,241,134 | B2 | * | 7/2007 | Neumeister | 431/5 |
| 7,335,015 | B2 | * | 2/2008 | Meier | 431/10 |
| 7,371,065 | B2 | * | 5/2008 | Aigner et al. | 431/326 |
| 7,469,647 | B2 | * | 12/2008 | Widmer et al. | 110/345 |

FOREIGN PATENT DOCUMENTS

| | | | | |
|---|---|---|---|---|
| DE | 100 45 270 | A1 | | 3/2002 |
| EP | 331 918 | A | | 9/1989 |
| EP | 331918 | A2 | * | 9/1989 |
| EP | 0 770 824 | A | | 5/1997 |
| EP | 1 331 444 | A | | 7/2003 |
| EP | 1331444 | A2 | * | 7/2003 |
| FR | 2830606 | A1 | * | 4/2003 |

OTHER PUBLICATIONS

Written Opinion of ISA and IPER (in German) for PCT/EP2005/006628.

* cited by examiner

METHOD FOR SETTING THE AIR RATIO ON A FIRING DEVICE AND A FIRING DEVICE

A method for setting operating parameters on a firing device, in particular on a gas burner with a fan, the temperature ($T_{actual}$) produced by the firing device being dependent upon the value of the air ratio ($\lambda$) and having a maximum ($T_{max}$) at the value $\lambda_1=1$. Moreover, the invention relates to a firing device, in particular a gas burner, which is adapted to implement the method.

In households, gas burners are used, for example as continuous-flow heaters, for preparing hot water in a boiler, or for providing heating heat. In the respective operating states, different requirements are made of the equipment. This relates in particular to the power output of the burner, generally called the burner load, and the temperature produced by the burner flame.

The burner load is substantially determined by the setting of the quantity of combustion air and of the mix ratio between gas and air. The mix ratio is set, in particular with gas burners used in households, by means of a pneumatic gas regulation valve (principle of the pneumatic combination). With the pneumatic regulation, pressures or pressure differences are measured at restricting orifices, in narrowings or in venturi nozzles. These values are used as control values for the gas regulation valve. However, a disadvantage of pneumatic regulation is in particular that sensitive mechanical components have to be used which are associated with hysteresis effects due to friction. In particular with low working pressures, inaccuracies therefore occur. Moreover, the cost of producing the pneumatic gas regulation valves equipped with membranes is considerable due to the high requirements for precision. Moreover, in the pneumatic combination, changes to the gas type and quality can not be reacted to flexibly. In order to be able to make, nevertheless, the required adaptations of the gas supply, additional devices, e.g. nozzles and restricting orifices, must be provided dependent upon the gas type, but this means additional expense.

With electronic control, however, a simply controllable gas regulation valve, possibly with a pulse width modulated coil or stepper motor, can be used in order to set the desired quantity of air and the desired gas/air mix ratio in association with a fan with a controllable speed (electronic combination). In this way it is possible to react flexibly to changes in the gas quality.

With a pre-determined quantity of air, the mix ratio between gas and air is to be set such that the gas combusts as completely and cleanly as possible. In order to characterise the mix ratio between gas and air the air ratio $\lambda$ is typically used. This is defined as the ratio of the actually supplied quantity of air to the quantity of air theoretically required for optimal stoichiometric combustion. In order to optimise the exhaust gas values (CO, $CO_2$), gas burners are typically operated with an excess of air. The desired value for the air ratio $\lambda_s$ for hygienically optimal combustion is 1.3. When operating a gas burner with an electronic combination, it must be ensured that with the different burner loads the air ratio $\lambda$ is always as close as possible to the desired value $\lambda_s$. In addition, it should be noted that the operating conditions can change after the equipment has started up, and then the parameters of the combustion regulation must be correspondingly adapted.

In EP 770 824 B1 a method is described in which, with the help of an ionisation electrode a calibration cycle is run through in order to adjust the electric desired value of the ionisation electrode. In this way, changes to the thermal coupling between the ionisation electrode and the gas burner which arise, for example, due to wear and tear, bending and due to contamination, are equalised.

With this method, which only falls back on the signal from the ionisation electrode, it is possible to exactly determine the ionisation signal for $\lambda=1$. However, the desired value for the air ratio can then not be set precisely because, for example, the characteristic line of the equipment is not taken into consideration.

It is therefore the object of the invention to specify a method with which the parameters for the combustion can be set, simply and reliably, on required burner loads. It is also the object of the invention to provide an appropriate apparatus with which the method can be implemented.

The object is fulfilled by a method according to the main claim and by an apparatus according to claim 6.

In the method for setting operating parameters on a firing device, in particular on a gas burner with a fan, the temperature ($T_{actual}$) produced by the firing device being dependent upon the value of the air ratio ($\lambda$) and having a maximum ($T_{max}$) at the value $\lambda_1=1$, the following steps are implemented:

controlling a pre-determined air mass flow ($m_L$);

establishing the gas mass flow ($m_{GTmax}$) corresponding to the temperature ($T_{max}$);

defining a desired value for the air ratio ($\lambda_{hy}$) for a desired hygienic combustion;

controlling the desired hygienic combustion by increasing the air mass flow ($m_L$) by the factor ($\lambda_{hy}$) with a constant supply of gas mass flow ($m_{GTmax}$).

The resulting actual temperature is recorded.

Starting with a mix ratio between air and fuel set at random or last set, the quantity of fuel supplied per unit of time with a constant quantity of air supplied per unit of time is changed continuously or in steps. By establishing and recording the temperature measured in the effective region of the burner flame, the quantity of fuel supplied per unit of time is set such that the measured temperature reaches a maximum. The quantity of air supplied per unit of time is then increased by the factor $\lambda_{hy}$, maintaining the previously set quantity of fuel using the air mass flow sensor. In this way, for any desired burner load with different gas qualities, but also by changing settings and by changing the characteristics of the sensors disposed on the gas burner, the desired value of the air ratio for hygienically optimal combustion is set accurately, safely and reliably.

For reasons relating to the design, it can be possible for the increase in air quantity to be inevitably also associated with an increase in the quantity of gas. In this case, a mix geometry formed with a suitable design can reduce the increase in the quantity of gas to a negligible value.

However, by using mass flow sensors in the gas mass flow, a control device without any structural adaptation can re-set the gas mass flow to the value $m_{GTmax}$ found with $T_{max}$ by appropriately manipulating the gas valve.

Finally, it is also possible to establish the increased gas mass flow by calculation and to set the air ratio $\lambda_{hy}$ correspondingly higher. It can then also be considered to reduce the quantity of gas by the calculated value, but this requires a very precise valve.

In particular when there are fluctuations in the quality of the combustion gas readjustment of the air ratio should be undertaken in order to guarantee hygienically optimal combustion. Re-adjustment of the air ratio can be implemented here, for example, at periodic intervals of time, when there is a load change, when operation is started or when the equipment is being serviced.

The firing device according to the invention, in particular a gas burner, is adapted for implementing one of the methods specified above.

In particular, the firing device has a temperature sensor in the effective region of the burner flame of the firing device. This temperature sensor can be disposed in the core of the flame, at the foot of the flame, at the top of the flame, but also some distance away from the flame, for example on the burner plate itself.

Moreover, the firing device preferably has a gas valve with a correcting element, in particular with a stepper motor, a pulse width modulated coil or with a coil controlled by an electric value. Because the method is particularly suitable for the electronic combination, the aforementioned valves, which can be actuated simply and with precision, can be used.

Furthermore, the firing device has a mass flow sensor and/or volume flow sensor for measuring the quantity of air supplied to the firing device per unit of time.

Further features and advantages of the object of the invention will become evident from the following description of particular examples of embodiments of the invention.

Figure 2:
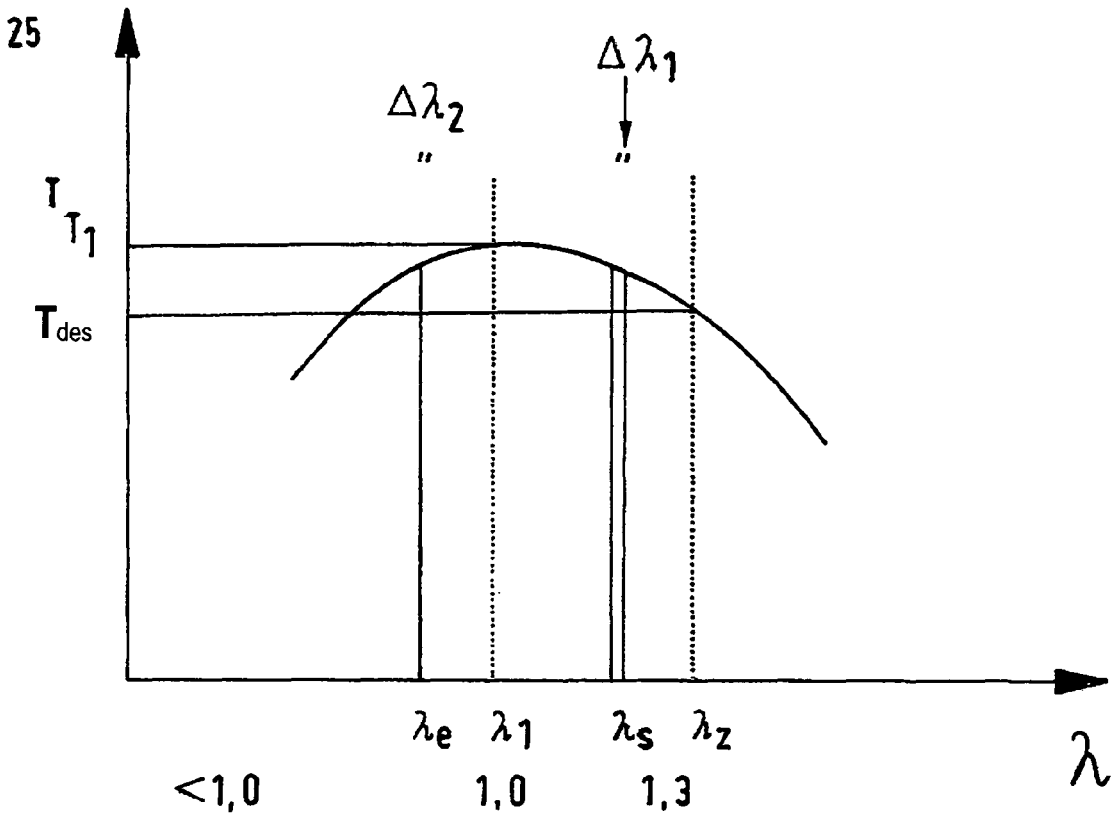
Figure 3:
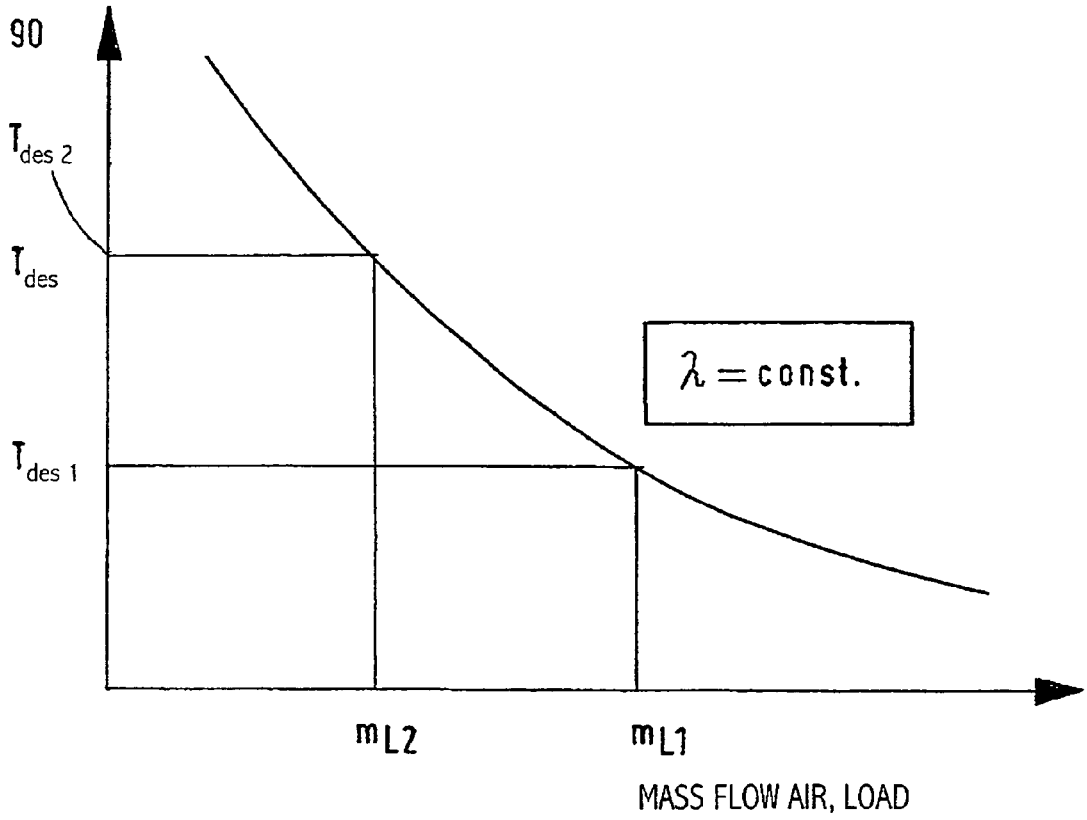

These show as follows:

FIG. 1 a firing device according to the invention;

FIG. 2 a characteristic for clarifying the method according to the invention;

FIG. 3 a further characteristic for clarifying the method according to the invention.

FIG. 1 shows a gas burner with which a mixture of air L and gas G is pre-mixed and combusted.

The gas burner has an air supply section 1 by means of which combustion air L is sucked in from a fan 9 with controllable speed. A mass flow sensor 2 measures the mass flow of the air L sucked in. The mass flow sensor 2 is disposed such that the most laminar flow possible is produced around it so as to avoid measurement errors. In particular, the mass flow sensor could be disposed in a bypass (not shown) and using a flow rectifier. With the help of the mass flow sensor and the fan 9 with controllable speed, the supply of air into the mixing region 8 can be precisely controlled.

For the supply of gas, a gas supply section 4 is provided which is attached to a gas supply line. The gas supply section can be provided with a mass flow sensor 5 of a suitable design. By means of a valve 6, for example a pulse width modulated or electronically controlled valve which e.g. is equipped with a control element with a stepper motor, the flow of gas through a line 7 into the mixing region 8 is controlled. In the mixing region 8 mixing of the gas G with the air L takes place. The fan 9 ventilator is driven with an adjustable speed so as to suck in both the air L and the gas G.

With a pre-determined air mass flow the valve 6 is opened sufficiently far such that the air/gas mixture passes with the desired mix ratio into the mixing region 8. The air ratio $\lambda$ is set here such that hygienically optimal combustion takes place.

The air/gas mix flows via a line 10 from the fan 9 to the burner part 11. Here, it passes out and feeds the burner flame 13 which is to emit a pre-determined heat output.

A temperature sensor 12, for example a thermoelement, is disposed on the burner part 11. With the help of this thermoelement an actual temperature is measured which is used when implementing the method described below for setting the desired value $\lambda h$ of the air ratio. In this example, the temperature sensor 12 is disposed on a surface of the burner part 11. It is also conceivable, however, to dispose the sensor at another point in the effective region of the flame 13. The reference temperature of the thermal element is measured at a point outside of the effective region of the flame 13, for example in the air supply line 1.

A device (not shown) for controlling and regulating the air and/or gas flow receives input data from the temperature sensor 12 and from the mass flow sensor 2, and emits control signals to the valve 6 and to the fan 9 drive. The opening of the valve 6 and the speed of the fan 9 ventilator are set such that the desired supply of air and gas is provided.

Control takes place by implementing the method described below. In particular, the control device has a storage unit for storing characteristics and desired values, as well as a corresponding data processing unit which is set up to implement the method.

The method according to the invention is described by means of the characteristic shown in FIG. 2. In this figure the measured temperature is shown dependent upon the air ratio $\lambda$.

At the start of the process, by means of the speed of the fan and the opening of the gas valve, a specific air ratio $\lambda_0$ is set which corresponds, for example, to the last value set. In this case $\lambda_0$ lies above the value $\lambda_1$ at which the temperature maximum $T_{max}$ is given. By increasing the mass flow of burnable gas supplied with a constant air mass flow $m_{L1}$, $\lambda$ is reduced. The change to the gas mass flow can be implemented here for example in steps, varying the steps of the stepper motor of the gas valve. With each step, the actual temperature $T_{actual}$ is determined by the temperature sensor 12 which is disposed in the region of the burner flame. Using a suitable iteration method, the opening of the gas valve is varied until the temperature maximum $T_{max}$ is set.

In the second method step, the air mass flow $m_{L1}$ is increased by the desired value $\lambda_{hy}$ of the air ratio, maintaining the opening of the gas valve. The new air mass flow $m_{hy}=\lambda_{hy} m_{L1}$ results. The air ratio is thus set exactly to the required desired value $\lambda_{hy}$, and combustion takes place in a hygienically optimal manner. After setting the desired air ratio $\lambda_{hy}$ the corresponding temperature $T_{desired}$ is measured.

With a load change, i.e. with a necessary change to the burner load, the method is generally implemented again. The method can also be implemented after switching on the gas burner or be repeated at periodical intervals of time. In this way it is ensured that the gas burner is constantly operated within an optimal range.

In order to prevent the method from having to be re-implemented with each load change, a second characteristic line, as shown in FIG. 3, can be established. In FIG. 3, the desired temperature $T_{desired}$, which was established as described in FIG. 2, is shown, dependent upon the air mass flow $m_{L1}$ which is directly in proportion to the burner load. The desired value of the air ratio $\lambda_{hy}$ is set precisely with a specific burner load if the temperature $T_{actual}$ measured in the effective region of the burner flame corresponds to the desired temperature $T_{desired}$ read out from FIG. 3. Regulation of the actual temperature $T_{actual}$ to the pre-determined desired value $T_{desired}$ automatically leads to setting of the optimal air ratio with a pre-determined burner load.

By using the characteristic shown in FIG. 3, over a specific period of time over which the basic conditions do not crucially change, the equipment can be operated without reimplementation of the method with changing burner loads, i.e. in different operating states. However, the characteristic should also be re-determined here at intervals of time or at specific occasions, for example when servicing the equipment in order to achieve adaptation to the gas quality made available or to instabilities in the system.

In FIG. 3, the desired temperature $T_{desired}$ dependent upon the mass flow of air $m_{L1}$, which corresponds to a specific burner load, is shown. If the load is changed from an operating state 1 to an operating state 2, according to the air mass flows $m_{L1}$ and $m_{L2}$, the temperature of the gas burner is regulated so that the temperature $T_{desired2}$ is set. Moreover, the air/gas mix is thinned or enriched by adjusting the gas valve 6.

Instead of totally re-determining the second characteristic according to FIG. 3, if so required, individual values with specific outputs can also be recorded and replace the values previously included in the characteristic. It is also conceivable to shift the characteristic overall according to a currently measured value with a specific load.

Implementation of the method leads to an operating mode with which hygienically optimal combustion is achieved.

The invention claimed is:

1. A method for setting operating parameters on a firing device, in particular on a gas burner with a fan, an actual temperature produced by the firing device being dependent upon a value of a specific air ratio and having a maximum operating temperature when the value of the specific air ratio equals 1, the method comprising:

controlling a pre-determined air mass flow;

establishing a gas mass flow corresponding to the maximum temperature;

defining a desired value for a hygienic air ratio for a desired hygienic combustion;

controlling the desired hygienic combustion by changing the pre-determined air mass flow by the desired value for the hygienic air ratio for the desired hygienic combustion while maintaining a constant supply of the gas mass flow;

measuring desired temperatures at different air mass flows corresponding to a desired air ratio, establishing a characteristic line which represents a correlation between the air mass flows and the desired temperatures at the desired air ratio;

regulating the actual temperature to a first desired temperature corresponding to a specific burner load at a first air mass flow using said characteristic line; and regulating the actual temperature to a second desired temperature different than the first desired temperature at a second air mass flow different than the first air mass flow using said characteristic line when a load change occurs.

2. The method according to claim 1, wherein the air mass flow corresponding to the hygienic desired value for the hygienic air ratio is controlled by changing a ventilator speed of the fan.

3. The method according to claim 1, wherein the air mass flow and/or the gas mass flow are measured respectively by a mass flow sensor.

4. The method according to claim 1, wherein the gas mass flow corresponding to the maximum temperature is established by iterative approximation of a value of the gas mass flow to a value corresponding to the maximum temperature.

5. The method according to claim 1, wherein the desired value for the hygienic air ratio is approximately 1.3.

6. The method according to claim 1, further comprising:

providing a gas burner and a fan to define the firing device; and operating the fan to supply the air mass flow to the gas burner.

7. The method according to claim 6, further comprising providing a temperature sensor in an effective region of a burner flame of the gas burner.

8. The method according to claim 6, further comprising providing a valve with a stepper motor, a pulse width modulated coil or a coil controlled by an electrical value.

9. The method according to claim 6, further comprising providing at least one mass flow sensor and/or volume flow sensor for measuring the quantity of air supplied to the gas burner per unit of time and/or the quantity of gas supplied per unit of time and/or the quantity of mixture of air and gas supplied.

10. The method according to claim 2, wherein the air mass flow and/or the gas mass flow are measured respectively by a mass flow sensor.

11. The method according to claim 2, wherein the gas mass flow corresponding to the maximum temperature is established by iterative approximation of a value of the gas mass flow to a value corresponding to the maximum temperature.

12. The method according to claim 3, wherein the gas mass flow corresponding to the maximum temperature is established by iterative approximation of a value of the gas mass flow to a value corresponding to the maximum temperature.

13. The method according to claim 2 wherein the desired value for the hygienic air ratio is approximately 1.3.

14. The method according to claim 3 wherein the desired value for the hygienic air ratio is approximately 1.3.

15. The method according to claim 4 wherein the desired value for the hygienic air ratio is approximately 1.3.

16. The method according to claim 7, further comprising providing a valve with a stepper motor, a pulse width modulated coil or a coil controlled by an electrical value.

17. The method according to claim 7, further comprising providing at least one mass flow sensor and/or volume flow sensor for measuring the quantity of air supplied to the gas burner per unit of time and/or the quantity of gas supplied per unit of time and/or the quantity of mixture of air and gas supplied.

18. The method according to claim 8, further comprising providing at least one mass flow sensor and/or volume flow sensor for measuring the quantity of air supplied to the gas blower per unit of time and/or the quantity of gas supplied per unit of time and/or the quantity of mixture of air and gas supplied.

* * * * *

UNITED STATES PATENT AND TRADEMARK OFFICE

CERTIFICATE OF CORRECTION

PATENT NO. : 7,922,481 B2
APPLICATION NO. : 11/630563
DATED : April 12, 2011
INVENTOR(S) : Geiger et al.

It is certified that error appears in the above-identified patent and that said Letters Patent is hereby corrected as shown below:

Col. 3, line 61, $\lambda$h" should be -- $\lambda_h$ --

Col. 4, line 65, "$m_{LI}$" should be -- $m_L$ --

Signed and Sealed this
Twenty-seventh Day of September, 2011

David J. Kappos

David J. Kappos
*Director of the United States Patent and Trademark Office*